US005941157A

United States Patent [19]

Tokumasu

[11] Patent Number: 5,941,157

[45] Date of Patent: Aug. 24, 1999

[54] VARIABLE CAPACITY SWASH PLATE COMPRESSOR

[75] Inventor: Hiroshi Tokumasu, Higashimatsuyama, Japan

[73] Assignee: Zexel Corporation, Tokyo, Japan

[21] Appl. No.: 09/006,665

[22] Filed: Jan. 13, 1998

[30] Foreign Application Priority Data

Jan. 31, 1997 [JP] Japan ..... 9-032638

[51] Int. Cl.[6] ..... F01B 3/00

[52] U.S. Cl. ..... 92/12.2; 92/57; 92/71; 92/154; 417/269; 184/6.17

[58] Field of Search ..... 184/6.17; 92/12.2, 92/57, 71, 154; 417/269

[56] References Cited

U.S. PATENT DOCUMENTS 4,979,877 12/1990 Shimizu ..... 92/154 X
5,685,215 11/1997 Jepsen et al. ..... 92/154 X
5,778,757 7/1998 Kristensen et al. ..... 92/12.2
5,784,950 7/1998 Kayukawa et al. ..... 92/154 X
5,785,150 7/1998 Tominaga et al. ..... 92/154 X

*Primary Examiner*—Hoang Nguyen
*Attorney, Agent, or Firm*—Frishauf, Holtz, Goodman, Langer & Chick

[57] ABSTRACT

A variable capacity swash plate compressor has a retainer mounted on its swash plate in a relatively rotatable manner with respect to the swash plate for supporting a plurality of shoes, and an annular retainer support plate for supporting the retainer in a state held in surface contact with one face of the retainer. The retainer support plate has an annular recess formed on a cylinder block-side face thereof, for holding lubricating oil therein, and a lubricating oil supply hole formed through a compressing piston-side portion thereof which does not receive tensile forces from pistons in the suction stroke, for supplying the lubricating oil from the annular recess to the one face of the retainer therethrough.

7 Claims, 6 Drawing Sheets

VARIABLE CAPACITY SWASH PLATE COMPRESSOR

BACKGROUND OF THE INVENTION

1. Field of the Invention

This invention relates to a variable capacity swash plate compressor, and more particularly to a variable capacity swash plate compressor having a construction which improves the slidability between a retainer for retaining shoes and a retainer support plate supporting the retainer.

2. Description of the Prior Art

FIG. 1 shows the whole arrangement of a conventional variable capacity swash plate compressor.

The conventional variable capacity swash plate compressor includes a drive shaft 105, a thrust flange 140 rigidly fitted on the drive shaft 105, for rotation in unison with the drive shaft 105, a swash plate 110 which is axially movably mounted on the drive shaft 105 via a hinge ball 109, for rotation in unison with the thrust flange 140, a plurality of pistons 107 slidably received in a plurality of cylinder bores 106, respectively, a plurality of shoes 150 arranged on a sliding surface 110*a* of the swash plate 110, for relative rotation with respect to the swash plate 110 according to the rotation of the drive shaft 105, a retainer 153 retaining the shoes 150, and a plurality of connecting rods 111.

Each connecting rod 111 has one end 111*a*, spherical in shape, slidably held in a corresponding one of the shoes 150, for relative rotation with respect to the corresponding shoe 150, and the other end 111*b* secured to the piston 107.

FIG. 2 is a view of the swash plate 110 taken from a rear side of the compressor.

The retainer 153 has its outer peripheral portion formed with a plurality of broken semi-annular portions 160 along its circumference through each of which a protruding portion 150*a* of each shoe 150 protrudes toward the piston 107. The retainer 153 is supported or held by a retainer support plate 155 which is fixed to a boss 110*a* of the swash plate 110 by bolts 154, such that the retainer 153 can perform relative rotation with respect to the retainer support plate 155.

Torque of an engine, not shown, installed on an automotive vehicle, not shown, is transmitted to the drive shaft 105 to rotate the same. The torque of the drive shaft 105 is transmitted from the thrust flange 140 to the swash plate 110 via a linkage 141 to cause rotation of the swash plate 110.

The rotation of the swash plate 110 causes relative rotation of each shoe 150 on the sliding surface 110*a* of the swash plate 110 with respect to the swash plate 110, whereby the torque transmitted from the swash plate 110 is converted into reciprocating motion of the piston 107. As each piston 107 reciprocates within the cylinder bore 106, the volume of a compression chamber within the cylinder bore 106 changes, whereby suction, compression and delivery of refrigerant gas are carried out sequentially. The inclination of the swash plate 110 varies with pressure within a crankcase 108 in which the swash plate 110 is received, so that high-pressure refrigerant gas is delivered in an amount or volume corresponding to an inclination of the swash plate 110.

The retainer 153 performs relative rotation (or sliding) with respect to the swash plate 110 while receiving tensile forces of pistons 107 in the suction stroke for drawing refrigerant gas into compression chambers, at corresponding portions of the retainer 153. The retainer support plate 155 supports or holds the retainer 153 in a state held in surface contact with a whole central portion of one face 153*a* of the retainer 153. Therefore, the conventional variable capacity swash plate compressor suffers from the inconvenience that when conditions of lubrication get worse, the sliding contact portions of the retainer 153 and the retainer support plate 155 are abraded, and untoward noises are produced.

SUMMARY OF THE INVENTION

It is an object of the invention to provide a variable capacity swash plate compressor having a construction which is capable of reducing abrasion of sliding contact portions of a retainer and a retainer support plate of the compressor and preventing noises from being produced by sliding contact between the retainer and the retainer support plate.

To attain the above object, the present invention provides a variable capacity swash plate compressor including a drive shaft, a rotating member rigidly fitted on the drive shaft, for rotation in unison with the drive shaft, a swash plate which is axially movably mounted on the drive shaft and tiltably connected to the rotating member, the swash plate having a sliding surface and a boss and rotating in unison with the rotating member as the rotating member rotates, a cylinder block, a plurality of cylinder bores axially formed through the cylinder block, a plurality of pistons slidably received in the cylinder bores, respectively, a plurality of shoes each arranged on the sliding surface of the swash plate for relative rotation with respect to the swash plate as the drive shaft rotates, a plurality of connecting rods each of which has one end slidably connected to a corresponding one of the shoes and another end connected to a corresponding one of the pistons, a retainer mounted on the swash plate in a relatively rotatable manner with respect to the swash plate, for retaining the shoes, the retainer having one face facing toward the cylinder block, and an annular retainer support plate rigidly fitted on the boss of the swash plate, for supporting the one face of the retainer, wherein an amount of stroke of each of the pistons changes according to an inclination of the swash plate.

The variable capacity swash plate compressor is characterized in that the retainer support plate has an annular recess formed on a cylinder block-side open face thereof, for holding lubricating oil therein, and a lubricating oil supply hole formed through a compressing piston-side portion thereof which does not receive tensile forces from pistons in a suction stroke, for supplying the lubricating oil from the annular recess to the one face of the retainer therethrough.

According to this variable capacity swash plate compressor, lubricating oil separates to be held within the annular recess and supplied via the lubricating oil supply hole to a clearance or interface between the retainer support plate and the retainer. The retainer and the compressing piston-side portion of the retainer support plate are not in intimate or tight contact with each other, which permits the lubricating oil held within the annular recess to be easily supplied all over sliding contact portions of the retainer and the retainer support plate via the lubricating oil supply hole formed through the compressing piston-side portion of the retainer support plate, thereby making smooth relative rotation (sliding) of the retainer with respect to the retainer support plate.

Preferably, the retainer has an oil-collecting portion formed around the lubricating oil supply hole, for collecting the lubricating oil held in the annular recess.

According to this preferred embodiment, lubricating oil held in the annular recess is collected in the oil-collecting portion and supplied in a sufficient amount via the lubricating oil supply hole to the clearance or interface between the retainer support plate and the retainer, so that the sliding contact portions of the retainer and the retainer support plate are positively lubricated, which makes it possible to reduce abrasion of the sliding contact portions of the two component parts of the compressor and at the same time prevent noises from being produced therefrom.

More preferably, the lubricating oil supply hole is formed close to a portion of the retainer which corresponds to a bottom dead center position of the each of the pistons.

According to this preferred embodiment, the lubricating oil supply hole is positioned at a location corresponding to an early stage of the compression stroke, so that lubricating oil supplied via this hole can easily flow between piston-compressing side portions of the retainer and the retainer support plate located backward with respect to the direction of rotation of the swash plate which are not in tight contact with each other, which permits the lubricating oil to be easily supplied all over sliding contact portions of the retainer and the retainer support plate, thereby making further smooth relative rotation (sliding) of the retainer with respect to the retainer support plate.

Preferably, the annular recess has a radial width which is largest at a location corresponding to the lubricating oil supply hole, and smallest at a location diametrically opposite to the location corresponding to the lubricating oil supply hole.

According to this preferred embodiment, since lubricating oil is collected efficiently at the portion of the annular recess surrounding the opening of the lubricating oil supply hole, it is possible to obtain similar effects as provided by the above preferred embodiment.

The above and other objects, features and advantages of the present invention will become more apparent from the following detailed description taken in conjunction with accompanying drawings.

DETAILED DESCRIPTION OF THE PREFERRED EMBODIMENTS

The invention will now be described in detail with reference to drawings showing preferred embodiments thereof.

Figure 4:
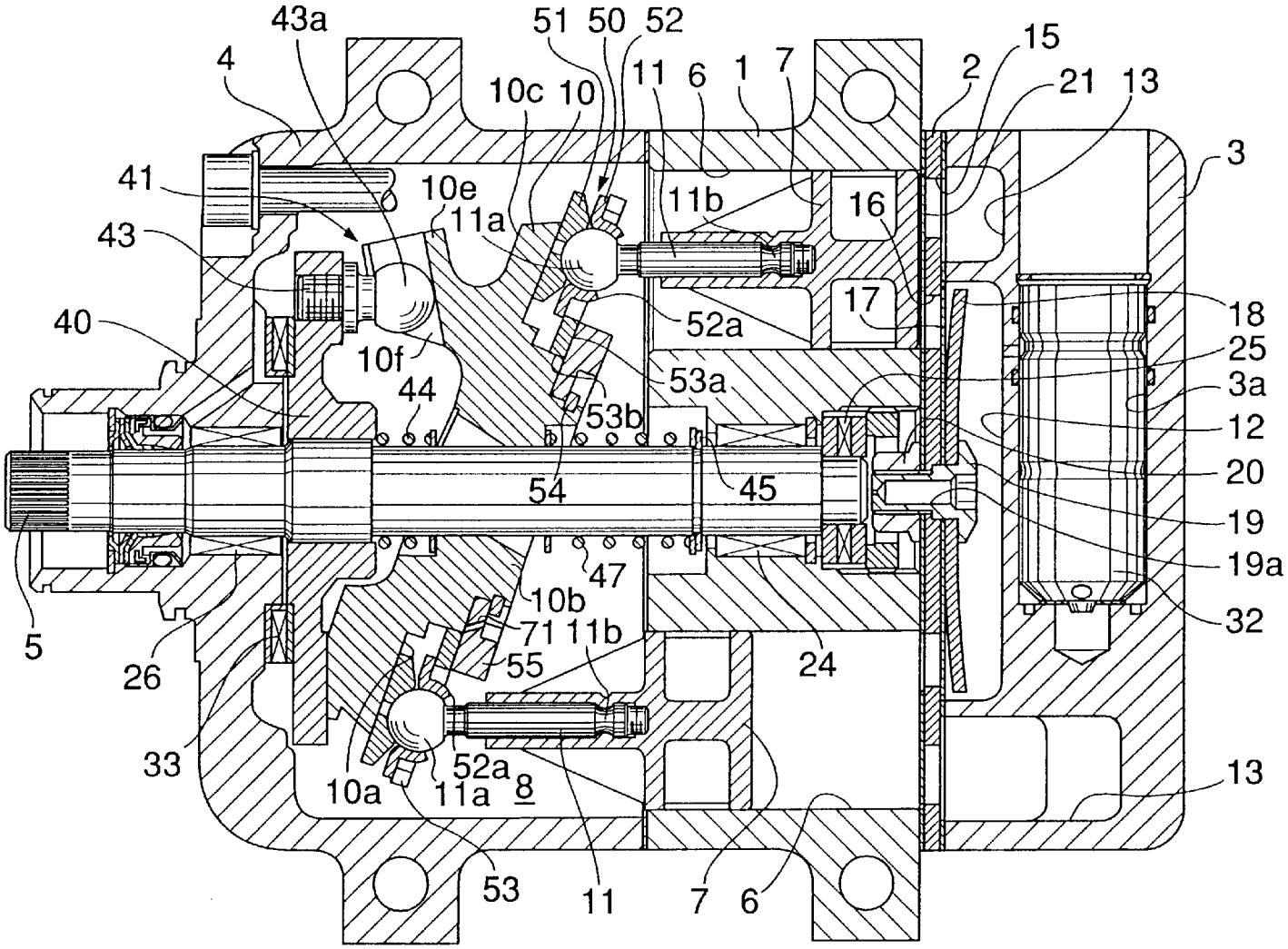
FIG. 4 is a longitudinal cross-sectional view, taken on line 4—4 in FIG. 3 showing the whole arrangement of the variable capacity swash plate compressor according to the first embodiment.

Referring first to FIG. 4, there is shown the whole arrangement of a variable capacity swash plate compressor according to a first embodiment of the invention.

The variable capacity swash plate compressor has a cylinder block 1 having one end thereof secured to a rear head 3 via a valve plate 2 and the other end thereof secured to a front head 4. The cylinder block 1 has a plurality of cylinder bores 6 axially formed therethrough at predetermined circumferential intervals about a drive shaft 5 rotatably extending therethrough. Each cylinder bore 6 has a piston 7 slidably received therein.

Within the front head 4, there is formed a crankcase 8. The crankcase 8 has a swash plate 10 received therein, which rotates in unison with the drive shaft 5. A plurality of shoes 50 to each of which is slidably connected one end 11*a*, spherical in shape, of a corresponding one of connecting rods 11, are retained on a sliding surface 10*a* of the swash plate 10 by a retainer 53. The retainer 53 is mounted on a boss 10*b* of the swash plate 10 in a manner supported or held by a retainer support plate 55 in an annular form described hereinbelow. Each connecting rod 11 has the other end portion 11*b* thereof secured to a corresponding one of the pistons 7.

Each piston 7 reciprocates within the cylinder bore 6 as the swash plate 10 rotates. The inclination of the swash plate 10 varies with pressure within the crankcase 8.

Figure 1:
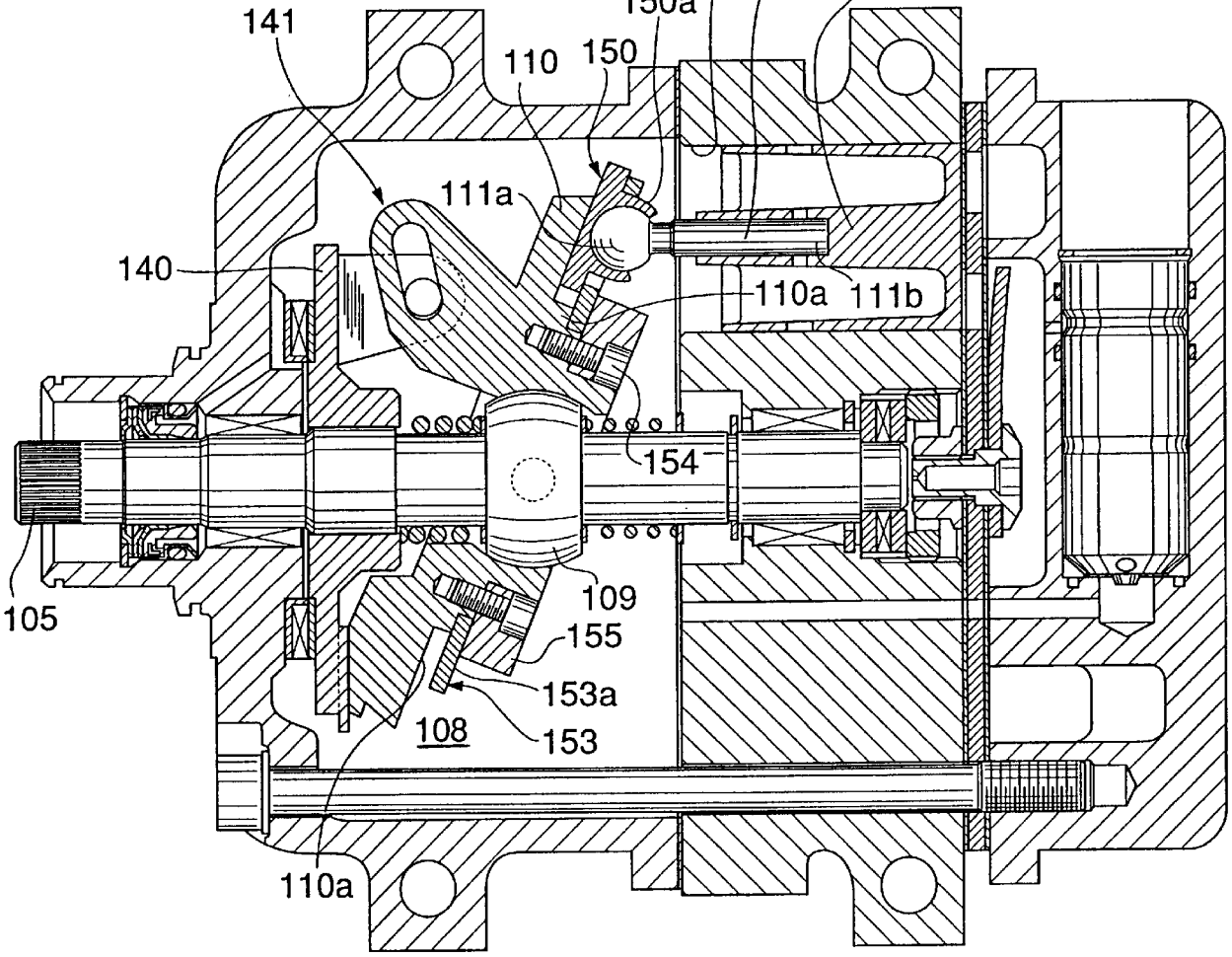
FIG.1 PRIOR ART
FIG. 1 is a longitudinal cross-sectional view showing the whole arrangement of a conventional variable capacity swash plate compressor.
Figure 2:
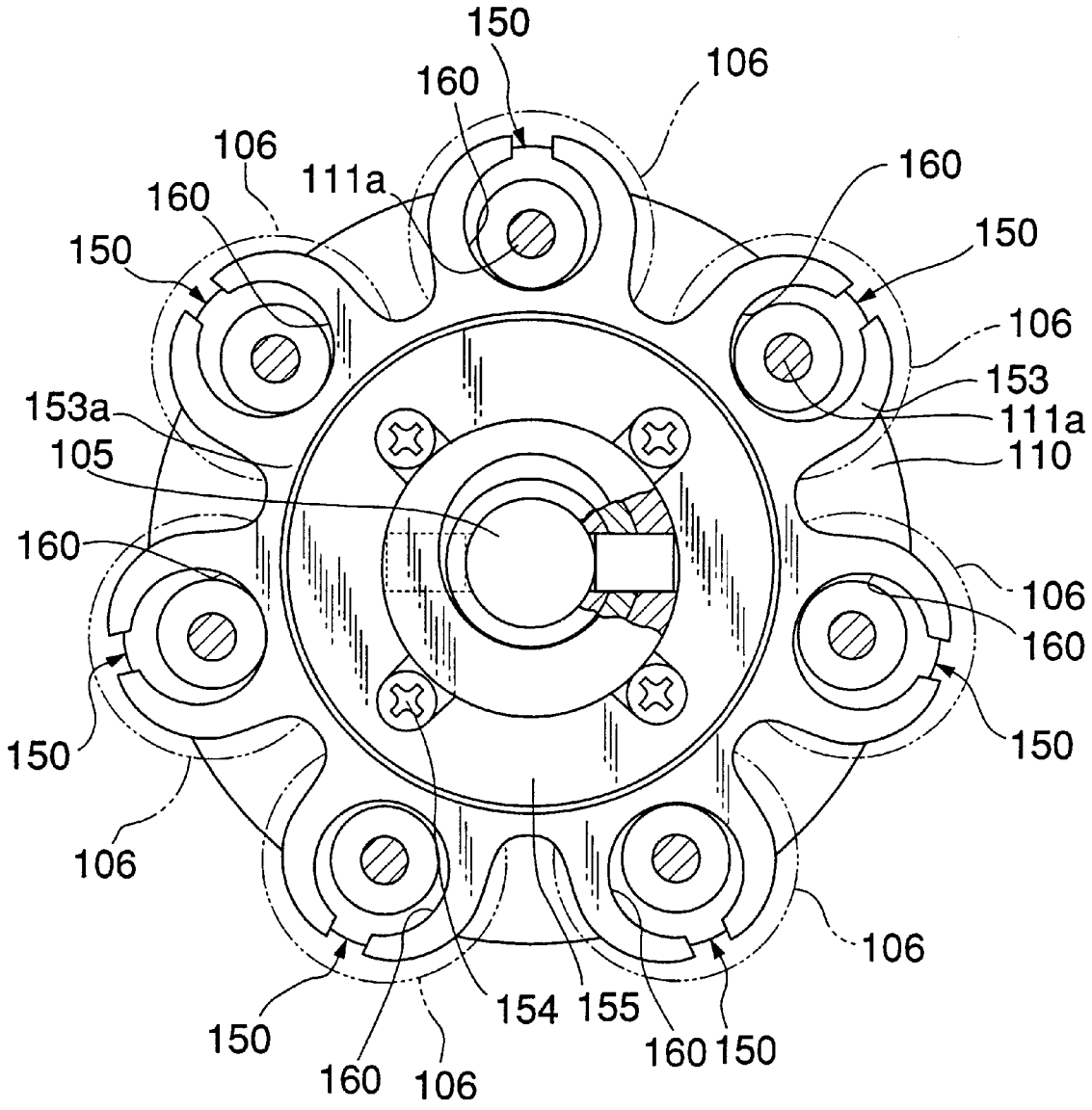
FIG.2 PRIOR ART
FIG. 2 is a view of a swash plate and component parts associated therewith of the FIG. 1 variable capacity swash plate compressor, taken from a rear side of the compressor.
Figure 3:
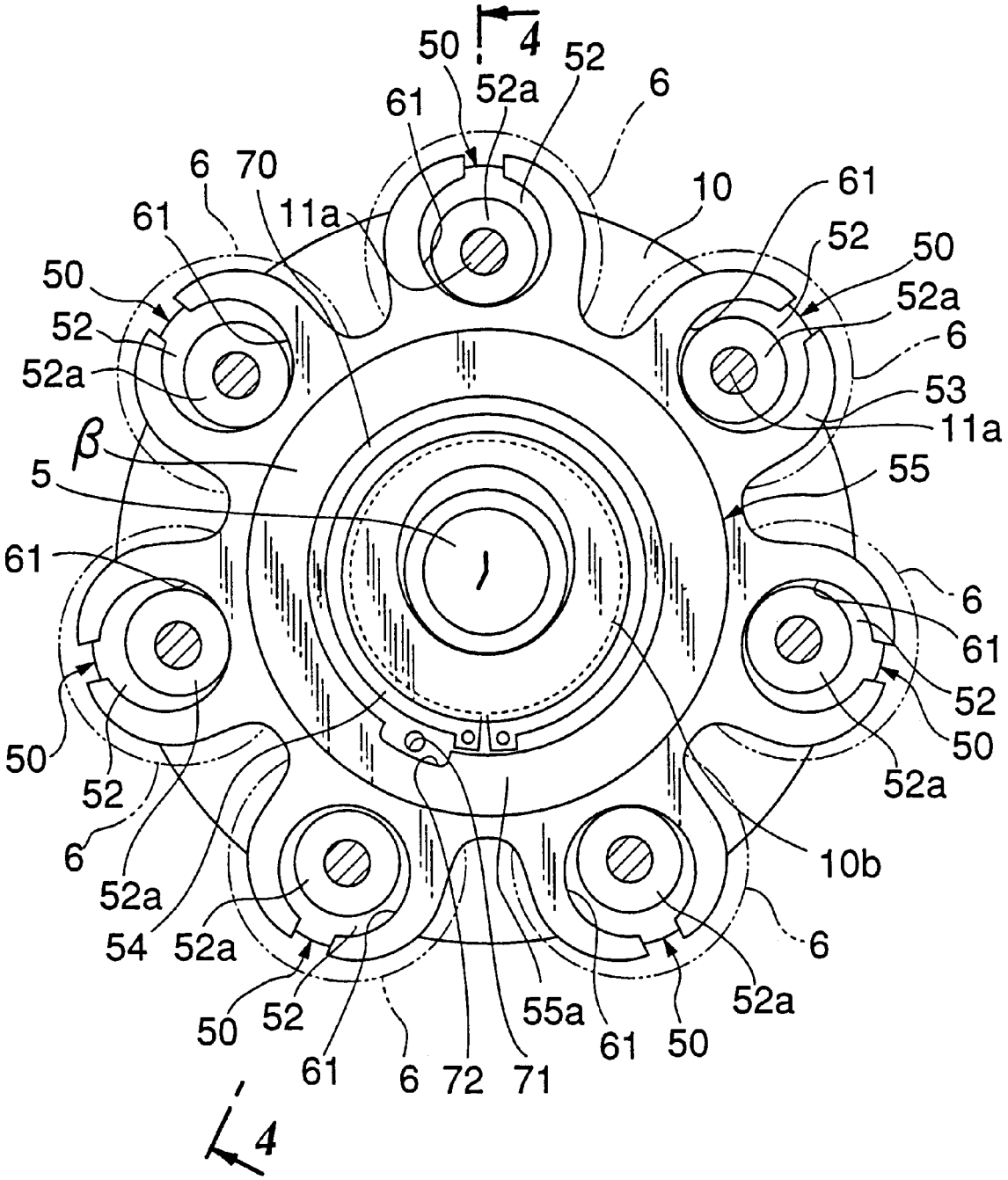
FIG. 3 is a view of a swash plate and component parts associated therewith of a variable capacity swash plate compressor according to a first embodiment of the invention, taken from a rear side of the compressor.
Figure 5A:
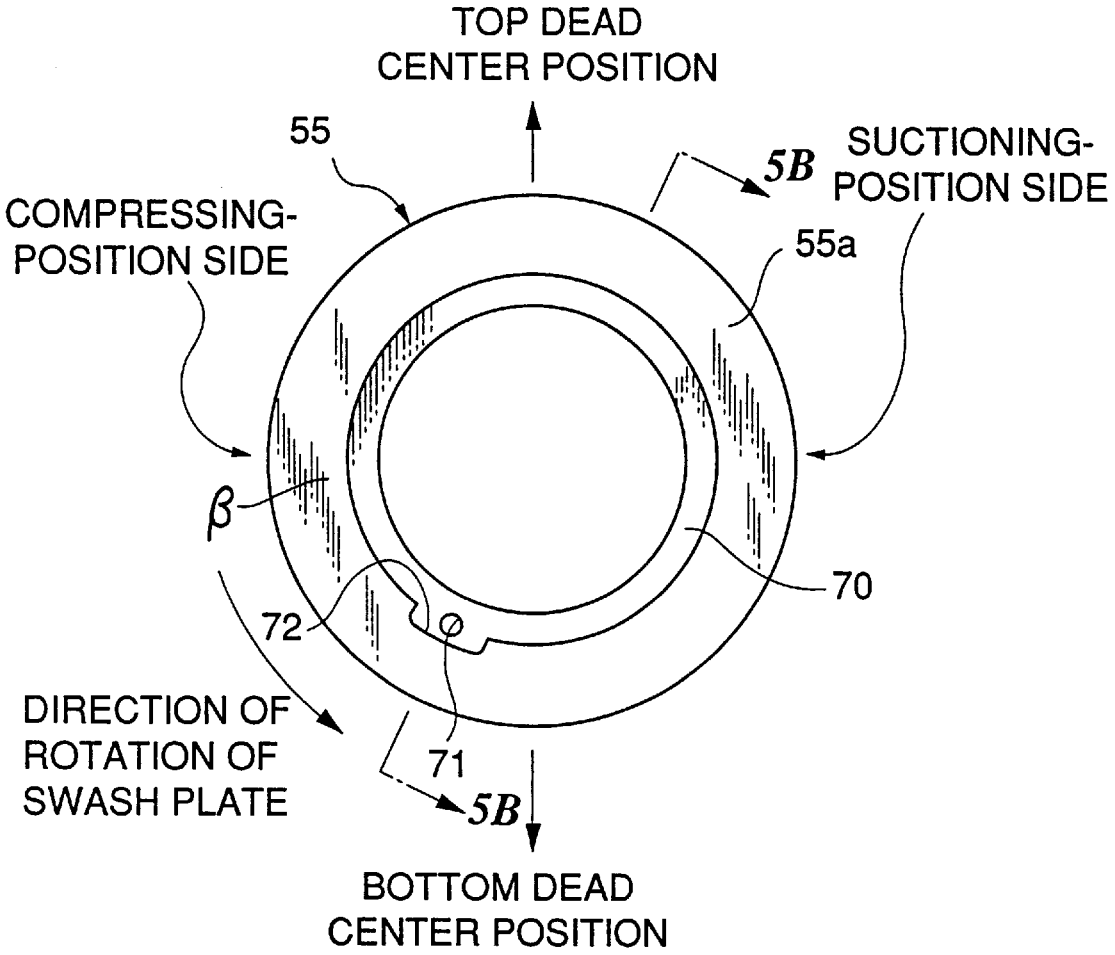
FIG. 5A is a plan view of a retainer support plate appearing in FIG.4.
Figure 5B:
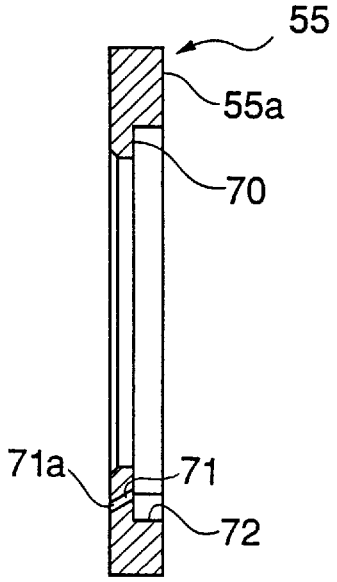
FIG. 5B is a cross-sectional view taken on line 5B—5B of FIG. 5A.

FIG. 3 is a view of the swash plate 10 and component parts associated therewith, which is taken from the rear side of the compressor. FIGS. 5A and 5B show the retainer support plate 55 of the variable capacity swash plate compressor according to the first embodiment. FIG. 5A is a plan view of the retainer support plate, while FIG. 5B is a sectional view taken on line 5B—5B of FIG. 5A.

Each shoe 50 is comprised of a first support member 51 for slidably supporting a front-side surface of the one end 11*a*, spherical in shape, of a corresponding one of the connecting rods 11 such that the one spherical end 11*a* of the connecting rod 11 is relatively rotatable with respect to the first support member 51, and a second support member 52 for slidably supporting or retaining a rear-side surface of the one end 11*a* of the same such that rear-side surface of the one end 11*a* of the same is relatively rotatable with respect to the second support member 52.

The retainer 53 is formed with a central through hole 53*b* which is fitted on a boss 10*b* of the swash plate 10. Further, the retainer 53 has its outer peripheral portion formed with a plurality of broken semi-annular portions 61 along the circumference thereof through each of which a protruding portion 52*a* of the second support member 52 of a corresponding one of the shoes 50 protrudes toward the piston 7. The retainer 53 is supported or held by the retainer support plate 55 which is fixed to the boss 10*b* of the swash plate 10 by a snap ring 54. The retainer support plate 55 is in surface contact with a central or inner portion of one face 53*a* of the retainer 53.

The retainer support plate 55 has a cylinder block-side open face 55*a* formed with an annular recess 70 for holding lubricating oil. The annular recess 70 is formed therein with a lubricating oil supply hole 71 leading to the one face 53*a* of the retainer 53. The annular recess 70 has the same radial width along its whole circumference. The lubricating oil supply hole 71 is formed at a compressing piston-side portion (substantially left half as viewed in FIG. 5A) β of the retainer support plate 55. The lubricating oil supply hole 71 includes an opening 71*a* (shown in FIG. 5B) formed on an outlet side thereof radially inward of the sliding surface 10*a* of the swash plate 10. In the present embodiment, the lubricating oil supply hole 71 is located slightly away from a bottom dead center position of the retainer support plate 55 into the compression side. An oil-collecting portion 72 is formed around the lubricating oil supply hole 71 for collecting lubricating oil within the annular recess 70.

Within the rear head 3, there are formed a discharge chamber 12 and a suction chamber 13 surrounding the discharge chamber 12.

The valve plate 2 is formed with refrigerant outlet ports 16 for respectively connecting the cylinder bores 6 with the discharge chamber 12 and refrigerant inlet ports 15 for respectively connecting the cylinder bores 6 with the suction chamber 13. The refrigerant outlet ports 16 and the refrigerant inlet ports 15 are arranged at predetermined circumferential intervals, respectively, about the drive shaft 5. Each refrigerant outlet port 16 is opened and closed by a discharge valve 17. The discharge valve 17 is fixed to a rear head-side end face of the valve plate 2 by a bolt 19 and nut 20 together with a valve stopper 18.

On the other hand, each refrigerant inlet port 15 is opened and closed by a suction valve 21 arranged between a front-side end face of the valve plate 2 and the cylinder block 1. The bolt 19 has a guide hole 19*a* for guiding high-pressure refrigerant gas from the discharge chamber 12 to a radial bearing 24 and a thrust bearing 25.

The radial bearing 24 and the thrust bearing 25 are arranged in the cylinder block 1 for rotatably supporting a rear-side end of the drive shaft 5, while a radial bearing 26 is arranged in the front head 4 for rotatably supporting a front-side end of the drive shaft 5.

Further, a communication passage 3*a* is formed for communication between the suction chamber 13 and the crankcase 8. Arranged at an intermediate portion of the communication passage 3*a* is a pressure control valve 32 for controlling pressure within the suction chamber 13 and pressure within the crankcase 8.

The drive shaft 5 has a thrust flange (rotating member) 40 rigidly fitted on a front-side portion thereof for transmitting torque of the drive shaft 5 to the swash plate 10. The thrust flange 40 is rotatably supported on an inner wall of the front head 4 by a thrust bearing 33. The thrust flange 40 and the swash plate 10 are connected with each other via a linkage 41. The swash plate 10 can tilt with respect to an imaginary plane perpendicular to the drive shaft 5.

The linkage 41 is comprised of a bracket 10*e* formed on a front-side surface 10*c* of the swash plate 10, a guide slot 10*f* formed in the bracket 10*e*, and a rod 43 secured to a swash plate-side end surface 40*a* of the thrust flange 40 by screw. The longitudinal axis of the guide slot 10*f* is tilted through a predetermined angle with respect to the front-side surface 10*c* of the swash plate 10. A spherical end portion 43*a* of the rod 43 is relatively slidably engaged with the guide slot 10*f*.

The swash plate 10 is mounted on the drive shaft 5 such that it is movable and tiltable in an axial direction. On the drive shaft 5 is fitted a coil spring 44 between the swash plate 10 and the thrust flange 40 to urge the swash plate 10 toward the cylinder block 1. Further, a coil spring 47 is mounted on the drive shaft 5 between a stopper 45 fixedly fitted on the drive shaft 5 and the swash plate 10 to urge the swash plate 10 toward the thrust flange 40.

Next, the operation of the variable capacity swash plate compressor constructed as above will be described.

Torque of an engine, not shown, installed on an automotive vehicle, not shown, is transmitted to the drive shaft 5 to rotate the same. The torque of the drive shaft 5 is transmitted to the swash plate 10 via the thrust flange 40 and the linkage 41 to cause rotation of the swash plate.

The rotation of the swash plate 10 causes relative rotation of each shoe 50 on the sliding surface 10*a* of the swash plate 10 with respect to the swash plate 10, whereby the torque transmitted from the swash plate 10 is converted into reciprocating motion of a piston 7 corresponding to the shoe 50. As the piston 7 reciprocates within the cylinder bore 6, the volume of a compression chamber within the cylinder bore 6 changes. As a result, suction, compression and delivery of refrigerant gas are sequentially carried out in the compression chamber, whereby high-pressure refrigerant gas is delivered from the compression chamber in an amount corresponding to an inclination of the swash plate 10. During the suction stroke, the suction valve 21 opens to draw low-pressure refrigerant gas from the suction chamber 13 into the compression chamber within the cylinder bore 6. During the discharge stroke, the discharge valve 17 opens to deliver the high-pressure refrigerant gas from the compression chamber to the discharge chamber 12.

Lubricating oil within blow-by gas and the high-pressure refrigerant gas introduced via the guide hole 19*a* of the bolt 19 separates to be held in the annular recess 70 of the retainer support plate 55. The lubricating oil held in the annular recess 70 is collected in the oil-collecting portion 72 by centrifugal force to be supplied via the lubricating oil supply hole 71 to a clearance or interface between the retainer support plate 55 and the retainer 53. The lubricating oil supply hole 71 is formed through the compressing piston-side portion β of the retainer support plate 55 at a location slightly away from the bottom dead center position of the same as described above, so that the retainer 53 and the retainer support plate 55 are not in tight contact with each other, which permits the lubricating oil to be easily supplied all over the sliding contact portions of the retainer support plate 55 and the retainer 53. Therefore, the retainer 53 can perform smooth relative rotation (or sliding) with respect to the swash plate 10 while receiving tensile forces of pistons 7 in the suction stroke for drawing refrigerant gas into respective compression chambers.

According to the variable capacity swash plate compressor of the first embodiment, lubricating oil is supplied via the lubricating oil supply hole 71 to the clearance or interface between the retainer support plate 55 and the retainer 53. Therefore, the sliding contact portions of the retainer 53 and the retainer support plate 55 are positively lubricated, which makes it possible to reduce abrasion of the sliding contact portions of the two component parts of the compressor and prevent noise from being produced.

Figure 6A:
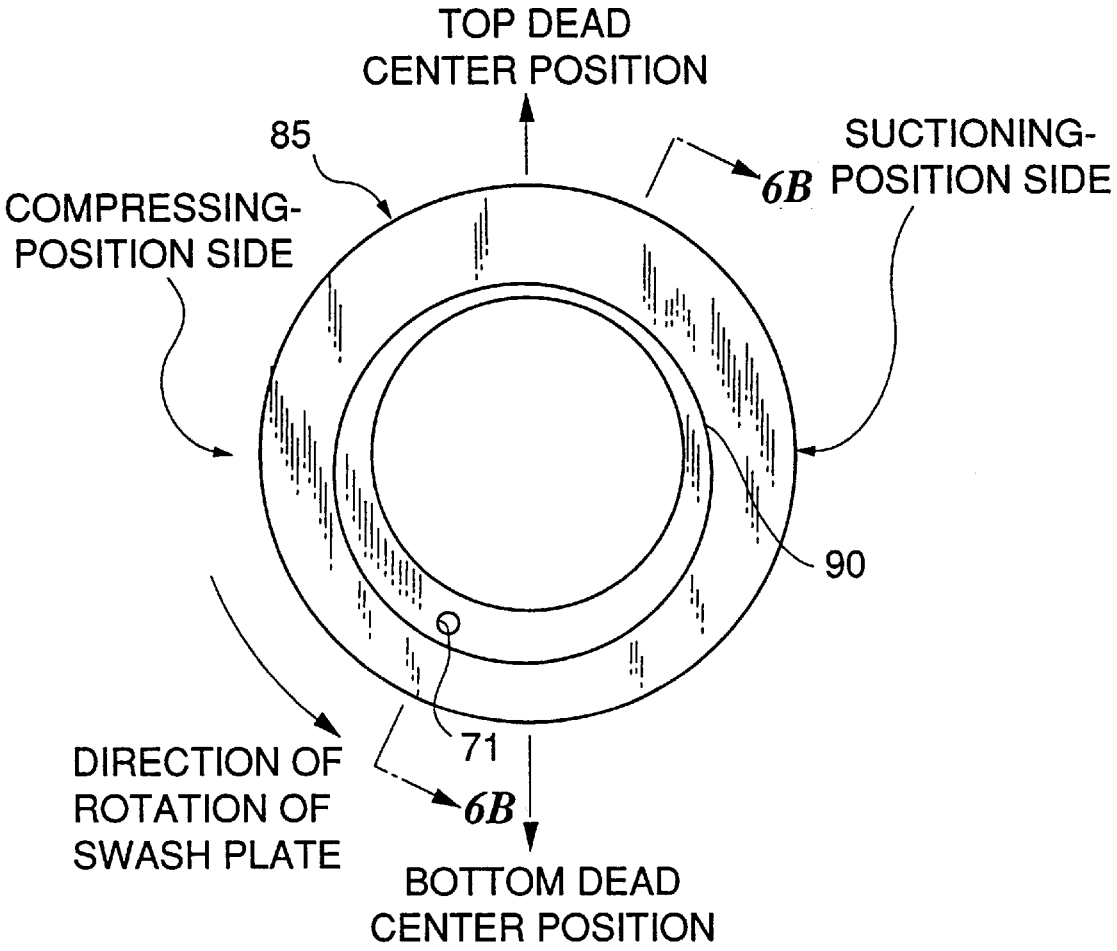
FIG. 6A is a plan view of a retainer support plate of a variable capacity swash plate compressor according to a second embodiment of the invention.
Figure 6B:
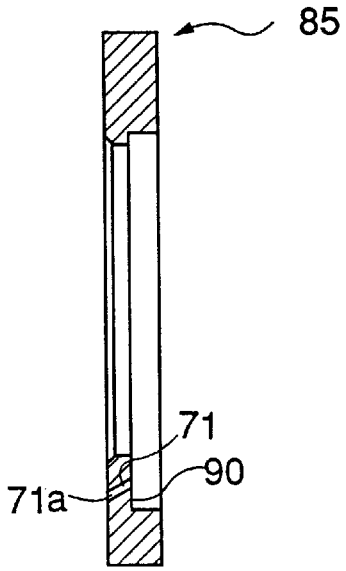
FIG. 6B is a cross-sectional view taken on line 6B—6B of FIG. 6A.

FIGS. 6A and 6B show a retainer support plate of a variable capacity swash plate compressor according to a second embodiment of the invention. FIG. 6A is a plan view of the retainer support plate, while FIG. 6B is a sectional view of the same taken on line 6B—6B of FIG. 6A. Component parts and elements corresponding to those of the above embodiment are indicated by identical reference numerals, and description thereof is omitted.

This embodiment is distinguished from the first embodiment, in which the annular recess 70 of the retainer support plate 55 has the same radial width along its whole circumference, in that, as shown in FIG. 6A, the retainer support plate 85 has an annular recess 90 whose radial width is largest in the vicinity of a lubricating oil supply hole 71, and smallest at a portion of the annular recess 90 diametrically opposite (with respect to the center of the retainer support plate 85) to the lubricating oil supply hole 71, i.e. 180 degrees circumferentially away from the lubricating oil supply hole 71.

The variable capacity swash plate compressor according to the second embodiment provides the same effects as obtained by the compressor of the first embodiment. Further, since lubricating oil is collected more efficiently in the vicinity of the lubricating oil supply hole 71, lubrication of the sliding contact portions of a retainer 53 and the retainer support plate 55 can be promoted, which makes it possible to positively prevent abrasion of the two sliding contact portions.

It is further understood by those skilled in the art that the foregoing is the preferred embodiments of the invention, and that various changes and modification may be made without departing from the spirit and scope thereof.

What is claimed is:

1. A variable capacity swash plate compressor comprising:

a drive shaft, a rotating member rigidly fitted on said drive shaft, for rotation in unison with said drive shaft, a swash plate which is axially movably mounted on said drive shaft and tiltably connected to said rotating member, said swash plate having a sliding surface and a boss and rotating in unison with said rotating member as said rotating member rotates, a cylinder block, a plurality of cylinder bores axially formed through said cylinder block, a plurality of pistons slidably received in said cylinder bores, respectively, a plurality of shoes each arranged on said sliding surface of said swash plate for relative rotation with respect to said swash plate as said drive shaft rotates, a plurality of connecting rods each of which has one end slidably connected to a corresponding one of said shoes and another end connected to a corresponding one of said pistons, a retainer mounted on said swash plate in a relatively rotatable manner with respect to said swash plate for retaining said shoes, said retainer having one face facing toward said cylinder block, and an annular retainer support plate rigidly fitted on said boss of said swash plate for supporting said one face of said retainer which faces toward said cylinder block, wherein a stroke amount of each of said pistons changes according to an inclination of said swash plate, and wherein said retainer support plate includes: (i) an annular recess formed on a cylinder block-side open face thereof for holding lubricating oil therein, and (ii) a lubricating oil supply hole, formed through a compressing piston-side portion thereof which does not receive tensile forces from the pistons in a suction stroke, for supplying said lubricating oil from said annular recess to said one face of said retainer which faces toward said cylinder block.

2. The variable capacity swash plate compressor according to claim 1, wherein said retainer includes an oil-collecting portion formed around said lubricating oil supply hole for collecting said lubricating oil held in said annular recess.

3. The variable capacity swash plate compressor according to claim 2, wherein said lubricating oil supply hole is formed close to a portion of said retainer support plate which corresponds to a bottom dead center position of said each of said pistons.

4. The variable capacity swash plate compressor according to claim 1, wherein said annular recess has a radial width which is largest at a location corresponding to said lubricating oil supply hole and which is smallest at a location diametrically opposite to said location corresponding to said lubricating oil supply hole.

5. The variable capacity swash plate compressor according to claim 1, wherein the lubricating oil supply hole includes an opening on an outlet side thereof radially inward of the sliding surface of the swash plate.

6. The variable capacity swash plate compressor according to claim 2, wherein the lubricating oil supply hole includes an opening on an outlet side thereof radially inward of the sliding surface of the swash plate.

7. A variable capacity swash plate compressor according to claim 3, wherein the lubricating oil supply hole includes an opening on an outlet side thereof radially inward of the sliding surface of the swash plate.

* * * * *